US005974749A

United States Patent [19]

Herbert

[11] Patent Number: 5,974,749

[45] Date of Patent: Nov. 2, 1999

[54] FLOOR-MOUNTED, DUST AND DEBRIS DISPOSAL SYSTEM

[76] Inventor: Mark S. Herbert, P.O. Box 155, Slebeggan Falls, Wis. 53085

[21] Appl. No.: 09/007,112

[22] Filed: Jan. 14, 1998

[51] Int. Cl.[6] ..... E04B 1/70

[52] U.S. Cl. ..... 52/302.1; 52/302.2

[58] Field of Search ..... 52/302.1, 302.2

[56] References Cited

U.S. PATENT DOCUMENTS 5,758,462 6/1998 Finn ..... 52/302.1

*Primary Examiner*—Beth Aubrey

*Attorney, Agent, or Firm*—Andrus, Sceales, Starke & Sawall

[57] ABSTRACT

A dust and debris disposal system is adapted to be mounted in an opening formed in a floor, and is used in conjunction with a dust a debris gathering device such as a broom or a mop. A housing is fixed to a flat upper surface of the floor and includes an inclined debris ramp, a raised support shell joined to the debris ramp and a downwardly depending neck extending through the opening in the floor. The debris ramp is defined by a ramp inlet formed by a peripheral edge of the housing, a ramp rim located inwardly from the ramp inlet and provided with a pair of ends, and a pair of spaced ramp curbs. Each of the curbs extends inwardly and upwardly at an inclined angle with respect to the ramp inlet and intersects with one end of the ramp rim. The support shell is formed with a sweep ridge extending opposite the ramp rim and at an elevation above the ramp rim. The ramp rim, the sweep ridge and the housing define a dust and debris orifice in communication with the tubular neck. A tubular debris shaft is connected to the neck, and a receptacle is attached to the debris shaft. With this construction, dust and debris gathered from the floor through the use of a broom or mop is swept to the ramp inlet up the debris ramp, guided by the ramp curbs and deposited over the ramp rim into the dust and debris orifice from which the dust and debris will fall by gravity through the neck and the debris shaft to the receptacle. Dust and debris remaining attached to the broom or mop is dislodged therefrom for release into the dust and debris orifice by engaging the broom or mop against the sweep ridge and/or dust loosening ribs extending forwardly and perpendicularly of the sweep ridge.

27 Claims, 3 Drawing Sheets

FLOOR-MOUNTED, DUST AND DEBRIS DISPOSAL SYSTEM

FIELD OF THE INVENTION

The present invention relates broadly to dust and debris collection arrangements and, more particularly, pertains to a disposal system in which dust and debris can be gathered and deposited into sub-floor collection receptacles without the use of conventional dust pans or the need to bend and/or reach to remove the dust and debris.

BACKGROUND OF THE INVENTION

Floor clean-up is a periodic necessity in most settings with increased frequency required in commercial and residential areas. The task of floor clean-up is generally divided into two phases: debris retrieval and debris removal. Debris retrieval typically consists of using a broom or dust mop to collect debris from throughout a work site, then positioning the gathered debris at an easily accessible location. Debris removal generally requires obtaining a dust pan or equivalent device, bending over to sweep the debris into the dust pan with the broom or mop, lifting the filled dust pan and transporting same to the open top of the wastebasket or the like, and tipping the dust pan to allow the debris to drop into the wastebasket. Debris removal is often the most tedious and tiresome of the two phases and can reduce the frequency of task completion. This often renders the work site unclean, and can leave the impression of unprofessionalism in commercial settings, such as in salons with hair clippings remaining on the floor from previous clients. Aspects of debris removal which often prove inconvenient include searching for dust pans, bending one's body and positioning dust pans to retrieve debris, lifting the debris and transporting the debris to trash receptacles without spilling the debris and returning the dust pans to storage locations. Sometimes dust and debris remaining attached to the broom or mop must be shaken off creating further problems in contaminating the surrounding environment. One, or a combination of these inconveniences can and often does reduce frequency of floor clean-up.

Traditionally, floor clean-up has relied upon brooms for debris retrieval and dustpans for debris removal. Although various advances have been attempted in broom and dust pan style and design, the process of floor clean-up has remained generally unchanged. The task of cleaning up has become abbreviated in completing only the debris retrieval phase, leaving debris gathered in corners or pathways of a room. For cosmetic and sanitary reasons, floor clean-up should always be completed at regular intervals depending on the type of environment present. There remains a need for a system designed to eliminate the inconveniences as noted above, as well as to allow for a more efficient and effective cleaning than has been done in the traditional manner.

Accordingly, it is desirable to provide a dust and debris disposal system which obviates the need for obtaining a dust pan or the like and reduces the potential of creating an environmental hazard encountered when shaking out a broom or a mop. It is also desirable to provide a dust and debris disposal system by which accumulated dust and debris is controlled and maintained relative to a closed receptacle thereby eliminating the need to transport and rid debris in traditional waste receptacles. Use of such a closed receptacle is desired for preventing spills and minimizing introduction of foreign particulates into the work site air.

SUMMARY OF THE INVENTION

The present invention advantageously provides a floor-mounted dust and debris repository which significantly enhances dust and debris removal, improves the frequency of clean-up and results in a safer and more sanitary work site.

It is a general object of the present invention to provide a dust and debris disposal system which does not require a dust pan or an above-the-floor-mounted waste receptacle.

It is another object of the present invention to provide a dust and debris disposal system which is conveniently mounted in a horizontal support surface of a commercial or residential work site and has no moving parts.

It is also an object of the present invention to provide a dust and debris disposal system which reduces the inconveniences associated with normal dust and debris removal.

Yet another object of the present invention is to provide a dust and debris disposal system to be typically used in conjunction with a broom or mop.

It is a further object of the present invention to provide a dust and debris disposal system which is relatively simple in construction, inexpensive to manufacture, and easy to install and use.

It is yet another object of the present invention to provide a dust and debris disposal system which is offered in a kit form.

In one aspect of the invention, a dust and debris disposal system is adapted to be mounted in an opening formed in a support surface for disposing dust and debris into a receptacle beneath the support surface. The disposal system includes a housing which is disposed upon an upper portion of the support surface. The housing has a dust and debris orifice in communication with the opening in the support surface. The housing is constructed and arranged such that dirt and debris will be guided by the housing into the orifice and will fall by gravity through the opening into the receptacle. The housing includes a downwardly depending tubular neck portion in communication with the orifice and extending through the opening in the support surface. The housing is provided with guide structure for enabling the transfer of dust and debris into the dust and debris orifice. In particular the guide structure is formed of a debris ramp and a support shell joined to the debris ramp. The debris ramp is defined by a ramp inlet, a ramp rim located inwardly of the ramp inlet and having a pair of ends, and a pair of spaced ramp curbs, each of the curbs extending inwardly from the ramp inlet and intersecting with one end of the ramp rim. The debris ramp connects the upper portion of the support surface with the dust and debris orifice. The support shell is secured to the debris ramp along the ramp curbs, is arch-shaped and includes a pair of leg portions connected by a bight portion located opposite the debris ramp. The bight portion includes a sweep ridge extending opposite the ramp rim at an elevation above the ramp rim. The sweep ridge supports a series of inwardly-extending, dust loosening ribs, each of which projects into the dust and debris orifice and is parallel to each other. The dust and debris orifice is formed by the ramp rim, the sweep ridge and the leg portions. The housing has a four-sided periphery, and, in the preferred embodiment, the guide structure has an inverted dish shape. A tubular debris shaft is interconnected between the neck and the receptacle and forms a conduit for conveying dust and debris to the receptacle.

In another aspect of the invention, a dust and debris disposal system is adapted to be mounted in an opening formed in a floor and used in conjunction with a dust and debris gathering device such as a broom or mop. The disposal system includes a housing fixed to a flat upper surface of the floor. The housing includes an inclined debris ramp, a raised support shell joined to the debris ramp and a downwardly depending neck extending through the opening in the floor. The debris ramp is defined by a ramp inlet formed by a peripheral edge of the housing, a ramp rim located inwardly from the ramp inlet and provided with a pair of ends, and a pair of spaced ramp curbs. Each of the ramp curbs extends inwardly and upwardly at an inclined angle with respect to the ramp inlet and intersects with one end of the ramp rim. The support shell is formed with a sweep ridge extending opposite the ramp rim and at an elevation above the ramp rim. The ramp rim, the sweep ridge, and the housing define a dust and debris orifice in communication with the tubular neck. A tubular debris shaft is connected to the neck and a receptacle is attached to the debris shaft. Dust and debris gathered from the floor through the use of a broom or mop is swept to the ramp inlet up the debris ramp, guided by the ramp curbs and deposited over the ramp rim into the dust and debris orifice from which the dust and debris will fall by gravity through the neck and debris shaft into the receptacle. Dust and debris remaining attached to the broom or mop are dislodged therefrom for release into the dust and debris orifice by engaging the broom or mop against the sweep ridge. The sweep ridge includes a plurality of parallel, dust loosening ribs extending into the dust and debris orifice, certain of the ribs being supported by a buttress. In the preferred embodiment of the invention, the housing has an inverted dish shape, and the neck has a constant diameter. In an alternative embodiment of the invention, the housing is substantially flat, and the neck has a downwardly-tapered diameter.

Still yet another aspect of the invention relates to a dust and debris disposal kit for mounting a disposal system in a through opening formed in a floor. The kit includes a template adapted to be placed on an upper surface of the floor for enabling formation of the through opening in the floor and formation of several auxiliary openings surrounding the through opening. A housing is disposed upon the upper surface of the floor, the housing having attachment structure disposable in the auxiliary openings, a dust and debris orifice and a downwardly depending tubular neck in communication with the dust and debris orifice, and extending through the through opening in the floor. Hardware is provided for fixing the attachment structure to the floor and a tubular debris shaft is attached to be connected to the neck.

Various other features, objects and advantages of the invention will be made apparent from the following description taken together with the drawings.

BRIEF DESCRIPTION OF THE SEVERAL VIEWS OF THE DRAWINGS

The drawings illustrate the best mode contemplated of carrying out the invention.

In the drawings.

DETAILED DESCRIPTION OF THE INVENTION

The present invention provides a simplified disposal system adapted to be mounted in a horizontal support surface and used in conjunction with a commercially available broom or mop. In the preferred embodiment, the horizontal support surface is described in terms of a substantially flat floor which is understood to be a single or multiple layer construction having ornamental and/or protective coverings such as tile and linoleum, as well as one or more reinforcing sub-floor layers. As will be appreciated, the present invention has particular utility in the floor of a room in a commercial or residential structure. However, it should be understood at the outset of this description that the present invention might find equal suitability in other debris collecting applications such as in the table top surface of a large elevated work surface, or the shelf of a cupboard.

Figure 1:
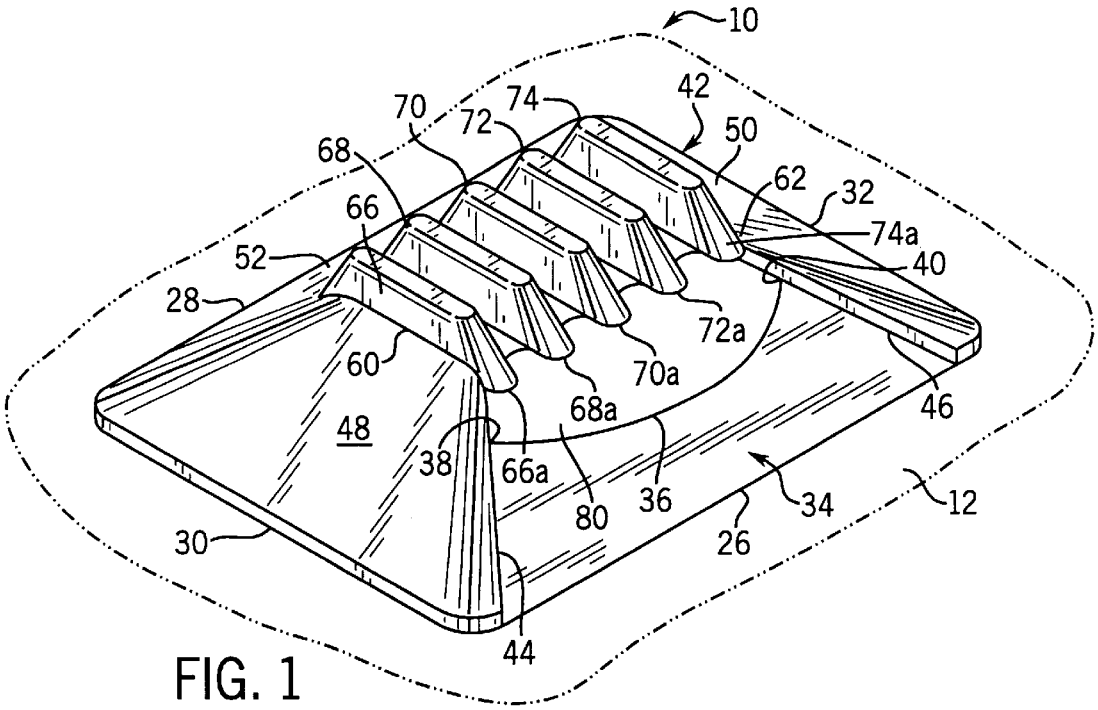
FIG. 1 is a perspective view of a preferred embodiment of a floor-mounted dust and debris disposal system in accordance with the present invention.
Figure 2:
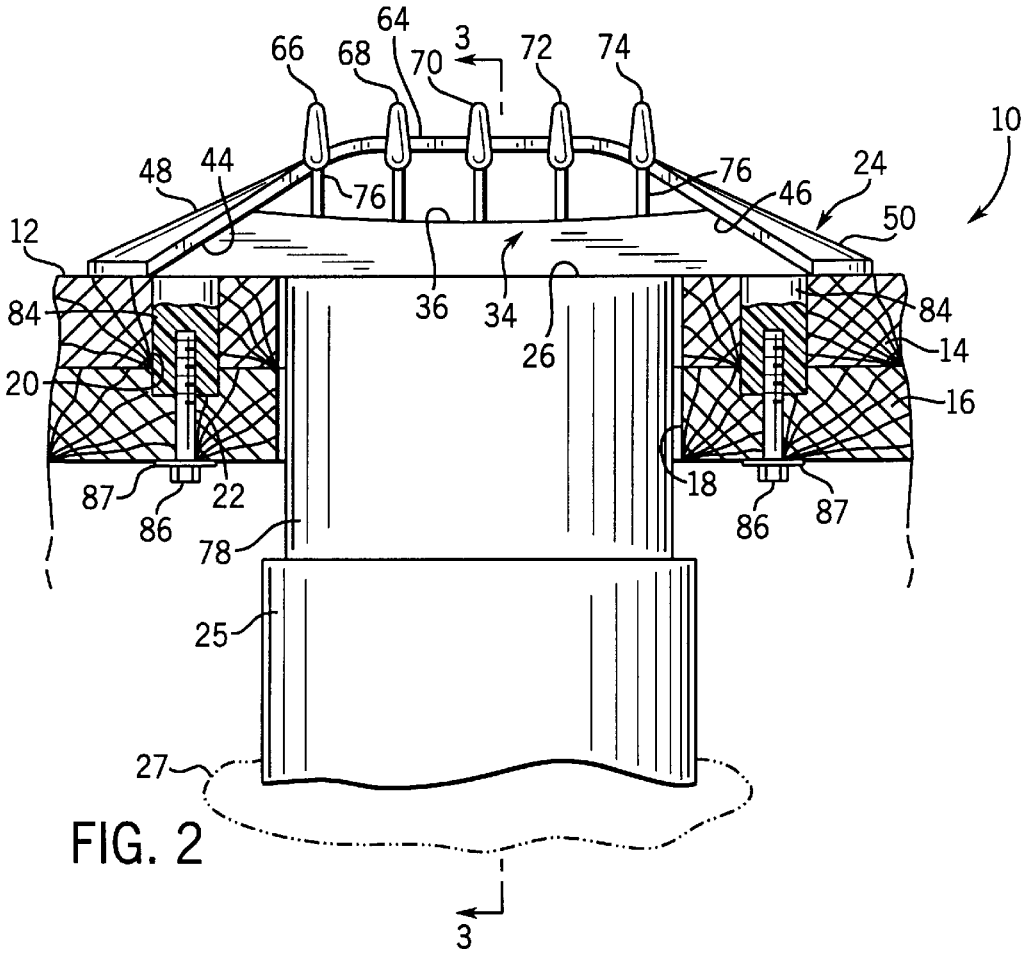
FIG. 2 is a partial transverse cross sectional view of the disposal system shown in FIG. 1.
Figure 3:
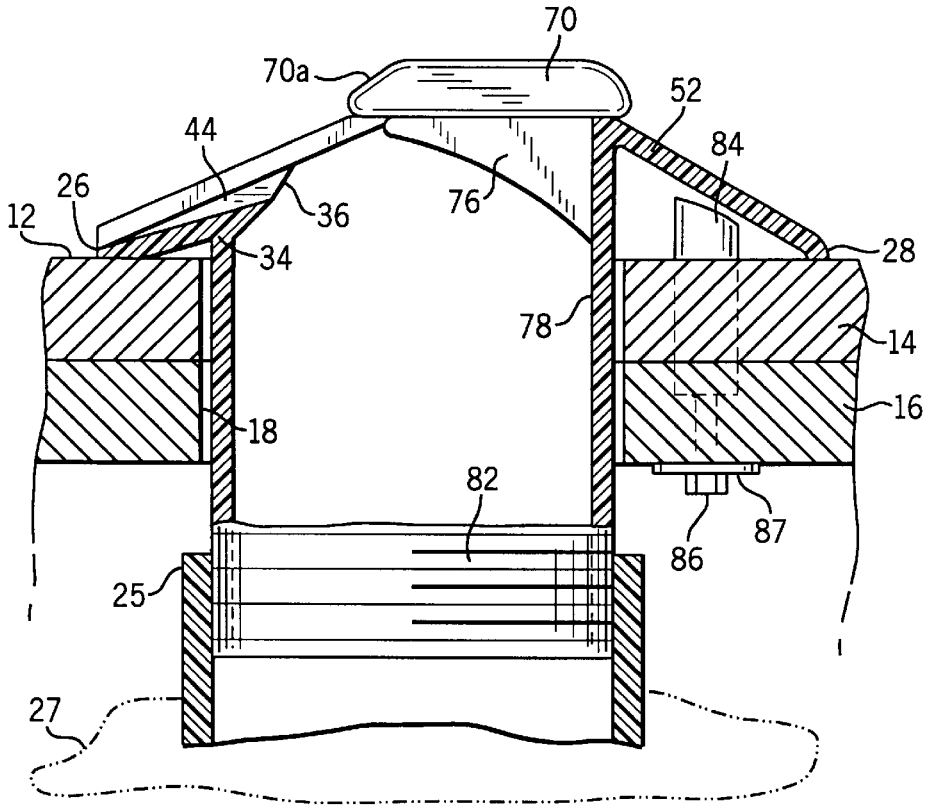
FIG. 3 is a cross sectional view taken on line 3—3 of FIG. 2.

Referring now to the drawings, FIG. 1 illustrates a perspective view of a dust and debris disposal system 10 mounted in a substantially flat, horizontal support surface or floor 12 of a room. In the preferred embodiment, a disposal system 10 is particularly desirable in a commercial setting such as the floor 12 of a salon or a kitchen of a restaurant. Throughout the drawings, the floor 12 is represented as a two layer wooden construction having a main floor 14 overlying a sub-floor 16, although the invention is not limited to this particular type of floor structure. As will be further explained hereafter, the floor 12 is pre-drilled with a central opening 18 which extends completely through the thickness or depth of the floor 12. The floor 12 is also cut with a series of anchor bores 20 which are spaced generally equidistantly from the central opening 18. As shown in FIGS. 2 and 3, the bores 20 are of a cylindrical formation having identical diameters significantly smaller than the central opening 18 and depths which typically extend from the floor upper surface into but not through the sub-floor 16. Once the bores 20 have been formed, a drill bit resembling the size of a bolt shaft is utilized to provide a further cylindrical fastener bore 22 extending from the bottom of each anchor bore 20 completely through the sub-floor 16. Alternately, one may drill the fastener bores 22 all the way through the floor first, and then use these bores as pilot holes for the larger bores 20.

The disposal system 10 is typically comprised of a one-piece housing 24, a tubular debris shaft 25, and a closed or open receptacle 27. Housing 24 is generally of a rectangular configuration when viewed in plan or from above, and includes a periphery having a front edge 26, a rear edge 28, and a pair of side edges 30, 32. In the disposal system 10 contemplated for a commercial application, housing 24 is preferably molded of a plastic material such as PVC which is extremely durable, yet lightweight and relatively economical to manufacture. An upper portion of housing 24 includes a debris ramp 34 sloping upwardly and inwardly from the front edge 26 which serves as a ramp inlet, and terminating in a curbed ramp rim 36 having spaced ends 38, 40. Debris ramp 34 is integrally joined to a raised contoured support shell 42 by means of a pair of spaced ramp curbs 44, 46, each of which extends upwardly and inwardly at an inclined angle with respect to the ramp inlet 26 and intersects one end of the ramp rim 36. As seen best in FIG. 3, the inclination of the ramp rim 36 is approximately 10° while the inclination of the top portion or crown of each ramp curb 44, 46 is slightly steeper or about 25°. Support shell 42 includes inclined side panels 48, 50 and an inclined rear panel 52 which rise from their respective side and rear edges 30, 32, 28, and together with the debris ramp 34 form an inverted dish-shaped guide structure. When viewed from above in FIG. 1, the support shell 42 is arch or horseshoe-shaped with the rear panel 52 forming a bight portion and the side panels 48, 50 forming leg portions. The side and rear panels 48, 50, 52 terminate in respective upper side panel edges 60, 62 and an upper rear panel edge or sweep ridge 64. As depicted in FIG. 2, the sweep ridge 64 lies at an elevation above the ramp rim 36. Projecting forwardly and perpendicularly from the sweep ridge 64 are a set of five elevated, dust, loosening ribs 66, 68, 70, 72, 74 which are oriented in parallel relationship and include downwardly and outwardly sloping broom-engaging noses 66*a*, 68*a*, 70*a*, 72*a*, 74*a*. As will be appreciated hereafter, the noses 66*a*–74*a* allow separation and channeling of bristles on a broom for enhanced dislodging of dust and debris. As seen in FIGS. 2 and 3, each of the ribs 66, 68, 70, 72, 74 are tear-dropped shaped in cross section, and are supported by a buttress 76 which braces the bottom of each rib with a rear portion of a tubular, cylindrical neck 78 of constant diameter that depends downwardly from the housing 24. Each of the outermost ribs 66, 74 are additionally supported by the respective upper edge 60, 62 of side panels 48, 50. The ramp rim 36, the sweep ridge 64 and the housing 24 define a dust and debris orifice 80 which communicates with the passageway formed by the neck 78. The lower portion of the neck 78 is formed with external threads 82 for removably receiving the internally and matingly threaded tubular debris shaft 25 from which the closed container or open receptacle 27 is attached or aligned.

In order to secure the disposal system 10 to the floor 12, a housing 24 is provided with a set of downwardly depending anchors or bosses 84. Although only two of these bosses 84 are shown in FIG. 2, it should be appreciated that a boss 84 is provided in the vicinity of each corner of the support shell 42. Typically each of the bosses 84 are internally threaded from the bottom to receive a cooperating fastener such as a bolt 86. A washer 87 is provided between the bolt head and the bottom of the sub-floor 16. As illustrated in FIG. 3, each boss 84 adjacent the rear edge may extend upwardly into the rear portion of the housing 24 so as to form a particularly effective anchor point when the housing 24 is installed in the floor 12.

Figure 6:
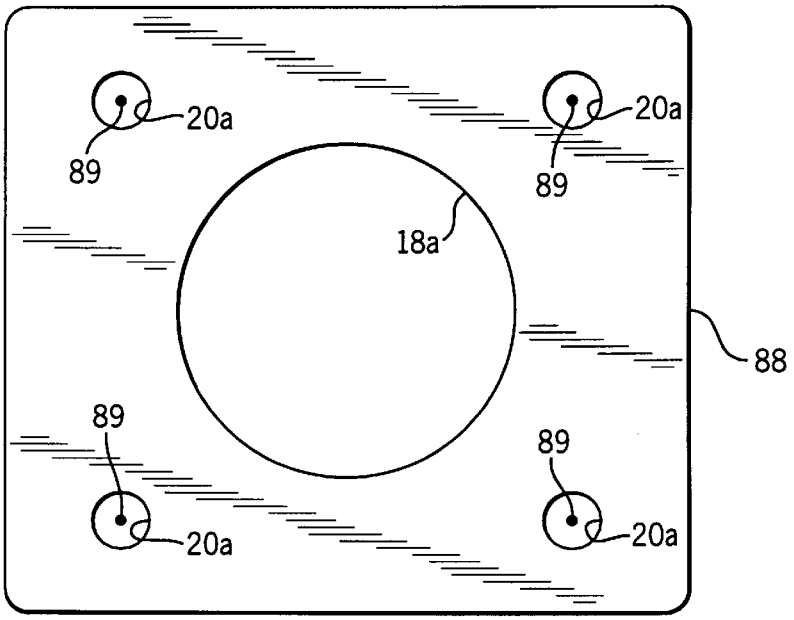
FIG. 6 a plan view of a template used in the installation of the disposal system of the present invention.

The disposal system 10 may advantageously be sold as a kit comprising the housing 24, hardware 86, 87 for attaching the housing 24 to the floor 12, and a template 88 (FIG. 6) for enabling drilling of the proper apertures in the floor 12. It may be desired to place the disposal system 10 out of the main walk pathways, in a corner of a room or in a closet. Once the location of the disposal system 10 is chosen, the template 88 is placed on the upper surface of the floor 12. First, the central opening 18 is cut directly downwardly entirely through the floor using the central opening 18*a* in the template 88. Then, the four anchor bores 20 are formed perpendicular to the floor 12 relying on the bore locations 20*a* surrounding the central opening 18*a* on the template 88. Centrally located dots 89 on the template 88 help to positively locate the centers of the bores 20*a*. As mentioned above, these anchor bores 20 extend partially into the floor 12 slightly more than halfway through the thickness of the floor 12. Next, the small diameter fastener bore 22 is formed perpendicularly from the bottom and center of each anchor bore 20 through the bottom of the floor 12. It should be understood that the bores 20,22 may alternatively be formed as discussed above. With the opening 18 and bores 20 completed, the one-piece housing 24 is placed on the floor 12 with the neck 78 extending downwardly through the central opening 18 and anchors 84 fitting into each one of the anchor bores 20 such that the housing peripheral edges 26, 28, 30, 32 lie flush upon the upper surface of the floor 12. Finally, headed bolts 86 are placed in the fastener bores 22 from the bottom of the sub-floor 16 and screwed tightly into the threaded recesses in the anchors 84 to securely fix the housing 24 in position. With the housing 24 secured to the floor 12, the debris ramp 34 connects the upper flat surface of the floor 12 to the dust and debris orifice 80.

In the preferred embodiment, the foot print or space occupied by the periphery of the housing 24 is typically 5½ inches in width and 6 inches in length with a dust and debris orifice 80 being sized to admit debris of the order of 1 inch in diameter, and the neck 78 having about a 3 inch diameter to allow an adequate passage of dust and debris to the receptacle 27. The type of debris being collected will dictate the type of receptacle 27 being attached to the tubular debris shaft 25. For example, dust and debris when collected tends to have a weight which will require a larger and/or stronger receptacle, whereas hair when accumulated remains relatively light and may be gathered in a larger, lighter receptacle. It should also be realized that, in some instances, receptacle 27 can be attached directly to the bottom of the neck 78 if desired, and that the debris shaft 25 may be angulated or curved as long as no severe blockage is created.

Using a broom or dustmop, dust and debris are retrieved from through-out the work site and accumulated at the debris ramp approach or inlet 26. It is then swept up the debris ramp 34 with most of the debris falling into the debris orifice 80 passing through the neck 78, the tubular debris shaft 25 and into the receptacle 27 beneath the floor 12. The angular difference between the disposition of the debris ramp 34 and the crown of the ramp curb 44, 46 keeps debris on track as it is swept up the ramp 34 and reduces curb overflow. Further dislodging of dust and debris is achieved by maneuvering the broom or mop back and forth forwardly and rearwardly against the sweep ridge 60. This maneuvering sends additional dust and debris through the orifice 80 and into the debris shaft 25 to the receptacle 27 below. Additional dislodging is accomplished by maneuvering the broom or mop from side to side onto the dust loosening ribs 66, 68, 70, 72, 74. Added pressure can be placed on the noses, 66*a*, 68*a*, 70*a*, 72*a*, 74*a* and sides of the ribs to promote breakup of the debris from the bristles or mop material. The configuration of the contoured support shell 42 along with its smooth surface creates a natural gradient by which debris that has not reached the orifice 80 is easily retrieved and returned to the ramp 34 to repeat the process. This method reduces spills and limits airborne particulates by keeping dust and debris localized to the housing 24 and near to the floor 12.

When the back edge of the housing 24 is up against a wall, utilization of the sweep ridge 60 may be limited due to the broom hitting the wall. In this case, the dusting ribs 66, 68, 70, 72, 74 may be the preferred structure for loosening dust and debris from the broom in a lateral maneuvering direction.

When a side edge of the housing 24 is placed against the wall, utilization of the dust loosening ribs 66, 68, 70, 72, 74 may be limited due to the broom hitting the wall. For this situation, the sweep ridge 60 may be the preferred method of loosening dust and debris from the broom in an anterior-posterior direction.

Figure 4:
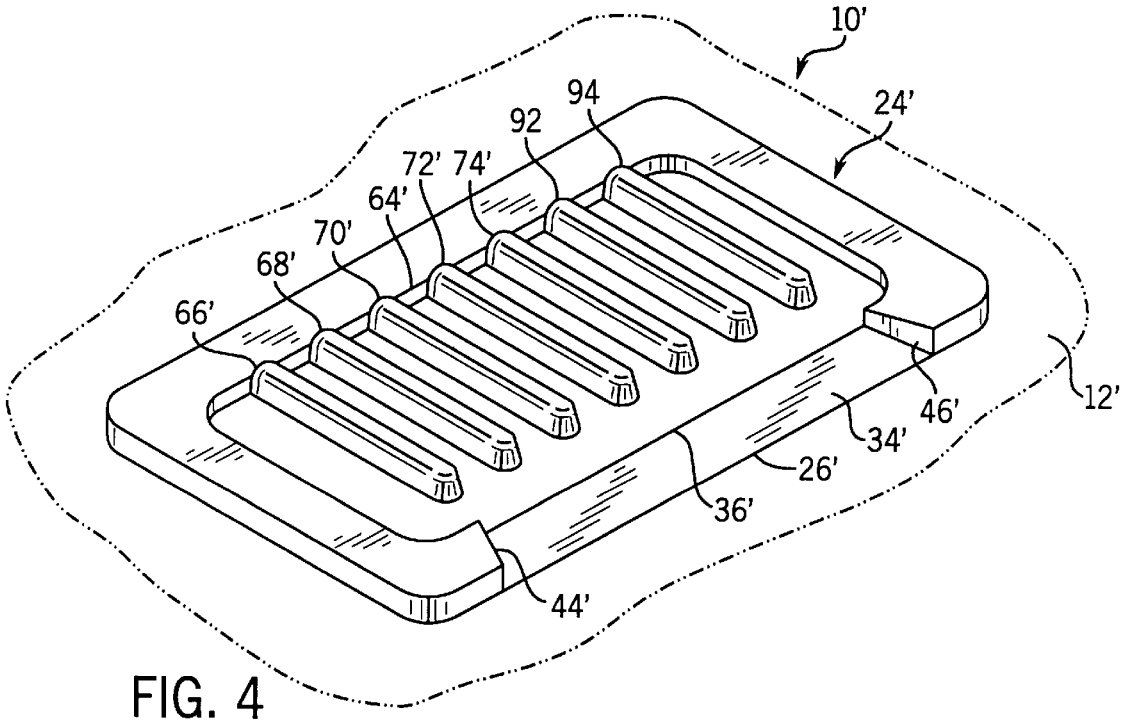
FIG. 4 is a perspective view of the an alternative embodiment of the present invention.
Figure 5:
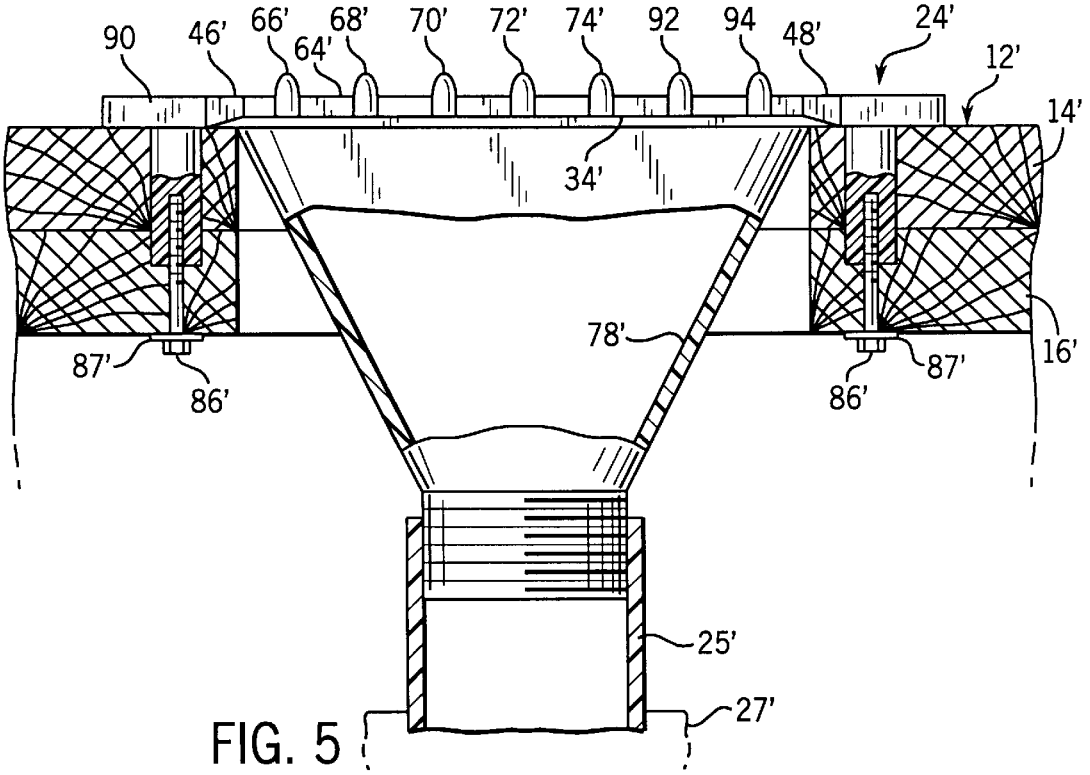
FIG. 5 is a transverse cross sectional view of the disposal system shown in FIG. 4.

FIGS. 4 and 5 show an alternative embodiment of the invention which is similar in basic construction to the disposal system 10 described above except for the following differences. Like reference numerals are used to denote like structural elements. Disposal system 10' includes a support shell 42' having a substantially flat, raised surface 90 and downwardly tapered neck 78'. Two additional ribs 92, 94 project from the sweep ridge 64' on the housing 24'. In this version, usually a smaller receptacle 27' is joined to or aligned with the bottom of the tubular debris shaft 25'. In all other respects, the structure and function of the disposal system 10' are similar to that described above. The structure of the alternative embodiment is preferred in a residential setting and resembles a cold air return in design. A foot print of the system 10' is typically 3½ inches in width by 6 inches in length with neck 78' tapering to 1½ inches in diameter. Such disposal system 10' is particularly desirable in the corner of a kitchen floor or in a broom closet.

It should be understood that the present invention provides a dust and debris disposal system which significantly enhances small sized dust and debris removal without the need for a dustpan or an above-the-floor mounted waste recept acle. The disposal system is relatively simple in construction and has no moving parts which might add a maintenance and safety concern. The present invention is generally inexpensive to manufacture and easy to install and use. The disposal system eliminates deeply bending one's back and knees which is normally required in the removal of dust and debris making the system more comfortable. The system promotes the increased frequency of cleaning and results in a safer and more sanitary worksite.

While the invention has been described with reference to a preferred embodiment, those skilled in the art will appreciate that certain substitutions, alterations and omissions may be made without departing from the spirit thereof. For example, a disposal system may be used in conjunction with a vacuum or blower system, if desired, in combination with or in lieu of a broom or mop. It should also be understood that the housing may be formed of different materials other than PVC and may be designed with various support shell configurations depending on the location and application of the disposal system. Accordingly, the foregoing description is meant to be exemplary only and should not be deemed limitative on the scope of the invention as set forth with the following claims.

I claim:

1. A dust and debris disposal system adapted to be mounted over an opening formed in a support surface such as a floor for disposing dust and debris into a receptacle beneath the support surface, the disposal system comprising:

a housing adapted to be disposed upon an upper portion of the support surface, the housing having a dust and debris orifice in communication with the opening in the support surface;

the housing being constructed and arranged such that dust and debris will be guided by the housing into the orifice and will fall by gravity through the support surface opening into the receptacle.

2. The disposal system of claim 1, wherein the housing includes a downwardly depending tubular neck in communication with the orifice and for extending through the opening in the support surface.

3. The disposal system of claim 1, wherein the housing includes a guide structure for enabling the transfer of dust and debris into the dust and debris orifice.

4. The disposal system of claim 3, wherein the guide structure includes a debris ramp and a support shell joined to the debris ramp.

5. The disposal system of claim 4, wherein the housing further includes a set of anchors for connecting the housing to the support surface.

6. The disposal system of claim 4, wherein the debris ramp is defined by a ramp inlet, a ramp rim located inwardly of the ramp inlet and provided with a pair of ends, and a pair of spaced ramp curbs, each of the curbs extending inwardly from the ramp inlet and intersecting with one of the ends of the rim.

7. The disposal system of claim 6, wherein the debris ramp is used for connecting the upper portion of the support surface with the dust and debris orifice.

8. The disposal system of claim 6, wherein the support shell is secured to the debris ramp along the ramp curbs.

9. The disposal system of claim 6, wherein the support shell is arch-shaped and includes a pair of leg portions connected by a bight portion.

10. The disposal system of claim 9, wherein the bight portion is located opposite the debris ramp.

11. The disposal system of claim 9, wherein the bight portion includes a sweep ridge extending opposite the ramp rim above the ramp rim.

12. The disposal system of claim 11, wherein the sweep ridge supports a series of parrallel inwardly extending dust loosening ribs.

13. The disposal system of claim 12, wherein each of the ribs projects into the dust and debris orifice.

14. The disposal system of claim 11, wherein the dust and debris orifice is formed by the ramp rim, the sweep ridge and the leg portions.

15. The disposal system of claim 1, wherein the housing has a four-sided periphery.

16. The disposal system of claim 2, wherein a tubular debris shaft is used for interconnecting the neck and the receptacle.

17. The disposal system of claim 4, wherein the guide structure has an inverted dish shape.

18. The disposal system of claim 12, wherein the ribs extend perpendicularly from the sweep ridge.

19. A dust and debris disposal system adapted to be mounted in an opening formed in a floor and used in conjunction with a dust and debris gathering device such as a broom or mop, the disposable system comprising:

a housing fixed to a flat upper surface of the floor, the housing including an inclined debris ramp, a raised support shell joined to the debris ramp, and a downwardly depending neck for extending through the opening in the floor, the debris ramp being defined by a ramp inlet formed by a peripheral edge of the housing, a ramp rim located inwardly from the ramp inlet and provided with a pair of ends, and a pair of spaced ramp curbs, each of the curbs extending inwardly and upwardly at an inclined angle with respect to the ramp inlet and intersecting with one end of the ramp rim, the support shell being formed with a sweep ridge extending opposite the ramp rim at an elevation above the ramp rim, the ramp rim, the sweep ridge and the housing defining a dust and debris orifice in communication with the neck;

a tubular debris shaft connected to the neck; and a receptacle attached to the debris shaft, whereby dust and debris gathered from the floor through the use of a broom or mop is swept to the ramp inlet up the debris ramp, guided by the ramp curbs and deposited over the ramp rim into the dust and debris orifice from which the dust and debris will fall by gravity through the neck and debris shaft into the receptacle, and whereby dust and debris remaining attached to the broom or mop is dislodged therefrom for release into the dust and debris orifice by the engaging of the broom or mop against the sweep ridge.

20. The disposal system of claim 19, wherein the sweep ridge includes a plurality of parallel, dust loosening ribs extending into the dust and debris orifice.

21. The disposal system of claim 20, wherein at least one of the ribs are supported by a buttress.

22. The disposal system of claim 19, wherein the support shell and the debris ramp joined thereto have an inverted dish-shape.

23. The disposal system of claim 19, wherein the support shell is a substantially flat, raised surface.

24. The disposal system of claim 19, wherein the neck has a constant diameter.

25. The disposal system of claim 19, wherein the neck has a downwardly tapered diameter.

26. The disposal system of claim 20, wherein the ribs extend perpendicularly from the sweep ridge.

27. A dust and debris disposal kit for mounting a disposal system in a through opening formed in a floor, the kit comprising:

a template adapted to be placed on an upper surface of the floor for enabling formation of the through opening in the floor and formation of at least one auxiliary opening adjacent the through opening; and a housing fixedly disposed upon the surface of the floor, the housing having an attachment structure disposable in the auxiliary opening, a dust and debris orifice and a downward depending tubular neck in communication with the dust and debris orifice and extending through the through opening in the floor.

* * * * *

UNITED STATES PATENT AND TRADEMARK OFFICE

CERTIFICATE OF CORRECTION

PATENT NO: 5,974,749

DATED: November 2, 1999

INVENTORS: MARK S. HERBERT

It is certified that error appears in the above-identified patent and that said Letters Patent is hereby corrected as shown below:

On the title page, item [75]:

Inventors: Cancel "Slebeggan" and substitute therefor --Sheboygan--;

Col. 9, Line 11, Cancel "20" and substitute therefor --19--

Signed and Sealed this

Twelfth Day of December, 2000

*Attest:*

Q. TODD DICKINSON

*Attesting Officer*

*Director of Patents and Trademarks*